US007228607B1

(12) United States Patent
Liu

(10) Patent No.: US 7,228,607 B1
(45) Date of Patent: Jun. 12, 2007

(54) PNEUMATIC HYDRAULIC RIVETER

(76) Inventor: Pao Fang Liu, No. 7, Lane 4, Kuang Sheng Hsin Cheng, San I Hsiang, Miao Li Hsien (TW)

( * ) Notice: Subject to any disclaimer, the term of this patent is extended or adjusted under 35 U.S.C. 154(b) by 0 days.

(21) Appl. No.: 11/533,439

(22) Filed: Sep. 20, 2006

(51) Int. Cl.
*B21J 15/12* (2006.01)
*B21D 9/05* (2006.01)
*B21D 31/00* (2006.01)

(52) U.S. Cl. ..... 29/243.526; 72/114; 72/391.8

(58) Field of Classification Search ..... 72/114, 72/391.4, 391.8; 29/243.524, 243.525, 243.526
See application file for complete search history.

(56) References Cited

U.S. PATENT DOCUMENTS 3,654,792 A * 4/1972 Mead ..... 72/391.8
4,559,806 A * 12/1985 Schwab ..... 72/114
4,612,793 A * 9/1986 Klein ..... 72/391.8
5,605,070 A * 2/1997 Wille ..... 72/114
6,272,899 B1 * 8/2001 Bentivogli ..... 29/243.526
6,732,563 B1 * 5/2004 Chen ..... 72/391.8
6,840,075 B2 * 1/2005 Neri et al. ..... 72/114

* cited by examiner

*Primary Examiner*—David Jones
(74) *Attorney, Agent, or Firm*—Ming Chow; Sinorica, LLC

(57) ABSTRACT

A pneumatic/hydraulic riveter includes a valve unit formed of a socket set and a control valve movable relative to the socket set to provide a forward rotation control air loop, a pulling control fluid loop, or a reverse rotation control air loop in such a manner that when one loop is provided the other two loops are closed, so that the riveting unit is controllable to perform a forward rotation action, a pulling action and a reverse rotation action in proper order.

11 Claims, 6 Drawing Sheets

PNEUMATIC HYDRAULIC RIVETER

BACKGROUND OF THE INVENTION

1. Field of the Invention

The present invention relates to riveters and more particularly, to a single valve type pneumatic/hydraulic riveter.

2. Description of the Related Art

An industrial or upholstery rivet-riveting riveter is a tool for use to fasten plate members with rivets. When the shank of a rivet is inserted through holes on plate members into the riveting mechanism of the riveter with the factory formed head of the rivet stopped at one side of one plate member, the lever of the riveter is operated to pull the shank of the rivet, thereby deforming the plain end of the rivet to form another head at the opposite side of the opposite plate member, and therefore the plate members are fastened together.

There is another kind of industrial or upholstery nut-riveting tool called nut-riveting riveter that is intensively used in the assembling of avionic products, computers, communication products, vehicles, machineries, and etc. to rivet blind nuts, securing parts, sheet members or pipe systems together. When using a nut-riveting riveter to fasten two plate members, a blind nut is mounted between the plate members, and then the front extension screw rod of the pull rod of the riveter is threaded into the blind nut (forward rotation action), and then the lever of the riveter is pressed to move the pull rod backwards (pulling action), thereby deforming the two sides of the blind nut to fasten the two plate members. After riveting, the pull rod is rotated in the reversed direction (reverse rotation action) to disconnect the front extension rod from the riveted nut.

A nut-riveting riveter and a rivet-riveting riveter works in a different way. A rivet-riveting riveter pulls the shank of the blind rivet backwards, thereby deforming the plain end of the rivet to form a head. A nut-riveting riveter must perform a forward rotation action, a pulling action, and a reverse rotation action in proper order when riveting a blind nut. Therefore, a riveter for riveting rivets cannot be used to rivet a nut. On the contrary, a riveter for riveting nuts is not practical for riveting rivets. Further, conventional nut-riveting riveters commonly use two valves to control the forward rotation action and the reverse rotation action respectively. According to this design, the mechanism may be not well retracted after riveting, and the user may waste much time to remove the riveted nut from the riveter.

Therefore, it is desirable to provide a riveter that eliminates the aforesaid drawbacks.

SUMMARY OF THE INVENTION

The present invention has been accomplished under the circumstances in view. It is one object of the present invention to provide a pneumatic/hydraulic riveter, which uses one single valve unit instead of conventional dual-valve designs to achieve the desired forward rotation action, pulling action and reverse rotation action for riveting blind nuts, thereby saving the manufacturing cost. It is another object of the present invention to provide a pneumatic/hydraulic riveter, which can be selectively used with a nut-riveting riveting unit for riveting blind nuts, or a rivet-riveting riveting unit for riveting blind rivets. It is still another object of the present invention to provide a pneumatic/hydraulic riveter, which uses a forward rotation air intake hole and a reverse rotation air intake hole to provide air for performing the forward rotation action and the reverse rotation action separately so that the riveted nut can be removed from the riveter safety after the reverse rotation action.

To achieve these and other objects of the present invention, the pneumatic/hydraulic riveter comprises a body, and a valve unit. The body comprises an air pump, a compressor motor, a forward rotation air intake hole in air communication with the compressor pump, a fluid intake hole in communication with the compressor pump, a reverse rotation air intake hole in communication with the compressor pump, a lever adapted to drive the air pump, a hydraulic unit, and a riveting unit. The riveting unit is driven to perform in proper order a forward rotation action, a pulling action and a reverse rotation action when the lever is biased. The body further has an exhaust hole for exhaust of air from the compressor motor when the lever is released. The valve unit is mounted inside the body, comprising a control valve and a socket set. The control valve is movable relative to the socket set to a first position to provide a forward rotation control air loop, a second position to provide a pulling control fluid loop, and a third position to provide a reverse rotation control air loop in such a manner that when one loop is provided the other two loops are closed. The forward rotation control air loop is in air communication between the compressor motor and the forward rotation air intake hole during forward rotation action of the riveting unit. The pulling control fluid loop is in fluid communication between the hydraulic unit and the fluid intake hole during pulling action of the riveting unit. The reverse rotation control air loop is in air communication between the compressor motor and the reverse rotation air intake hole during reverse rotation action of the riveting unit.

DETAILED DESCRIPTION OF THE PREFERRED EMBODIMENT

Figure 1:
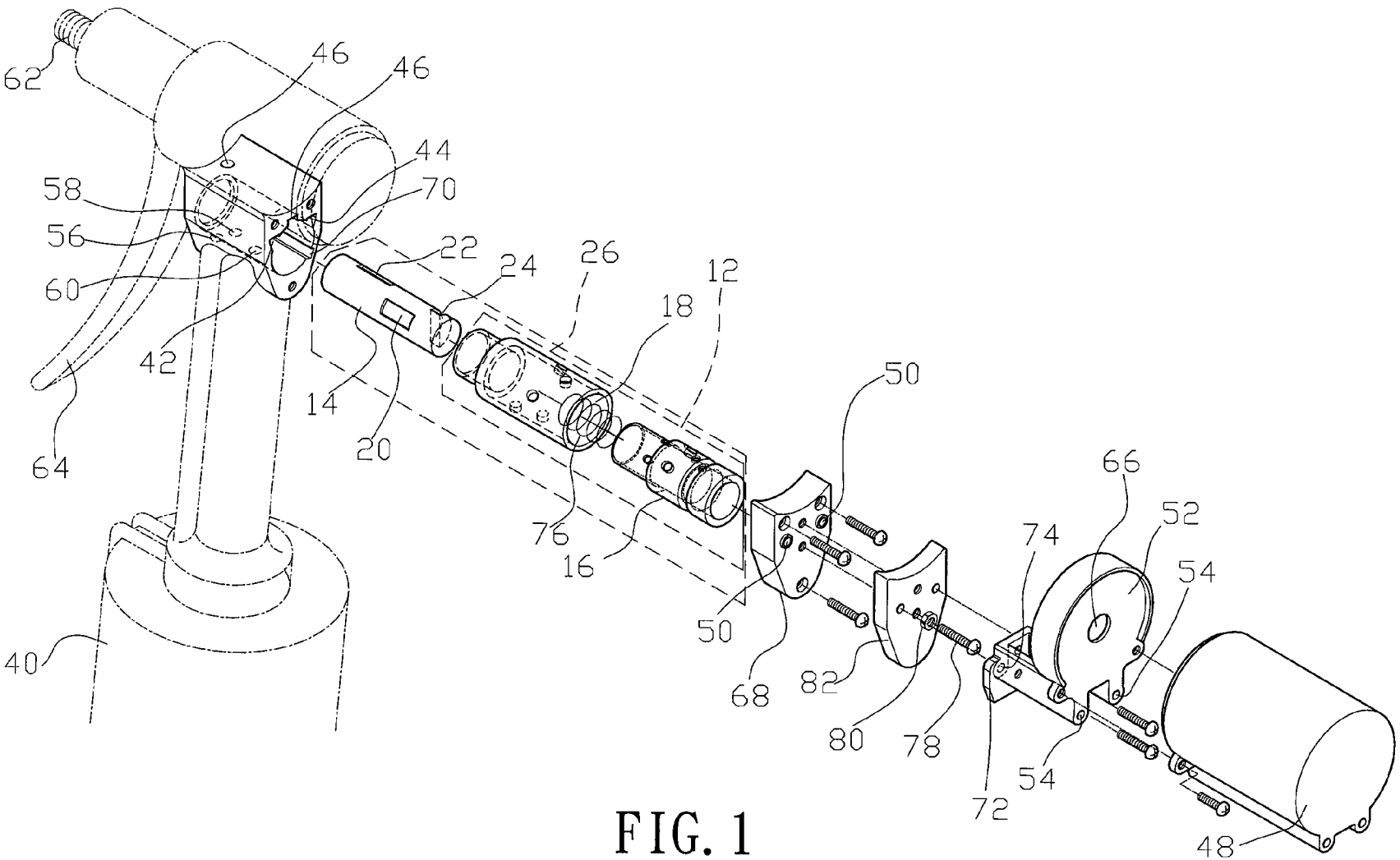
FIG. 1 is an exploded view of a pneumatic/hydraulic riveter according to the present invention.

Referring to FIG. 1, a valve unit 12 is shown mounted inside a body 40. The valve unit 12 is comprised of a control valve 14, an inner barrel 16, and an outer barrel 18. The control valve 14 is slidably mounted in the inner barrel 16, which is slidably mounted in the outer barrel 18. The control valve 14 has a forward rotation control section 20, a pulling control section 22, and a reverse rotation control section 24. The inner barrel 16 and the outer barrel 18 are coupled together, thereby constituting a socket set 26. As illustrated, the inner barrel 16 and the outer barrel 18 each define three separated passages, namely, the forward rotation control passage 28, the pulling control passage 30, and the reverse rotation control passage 32. The forward rotation control passage 28, the pulling control passage 30 and the reverse rotation control passage 3 are opened only when matched with the forward rotation control section 20, the pulling control section 22 and the reverse rotation control section 24 respectively.

Figure 2:
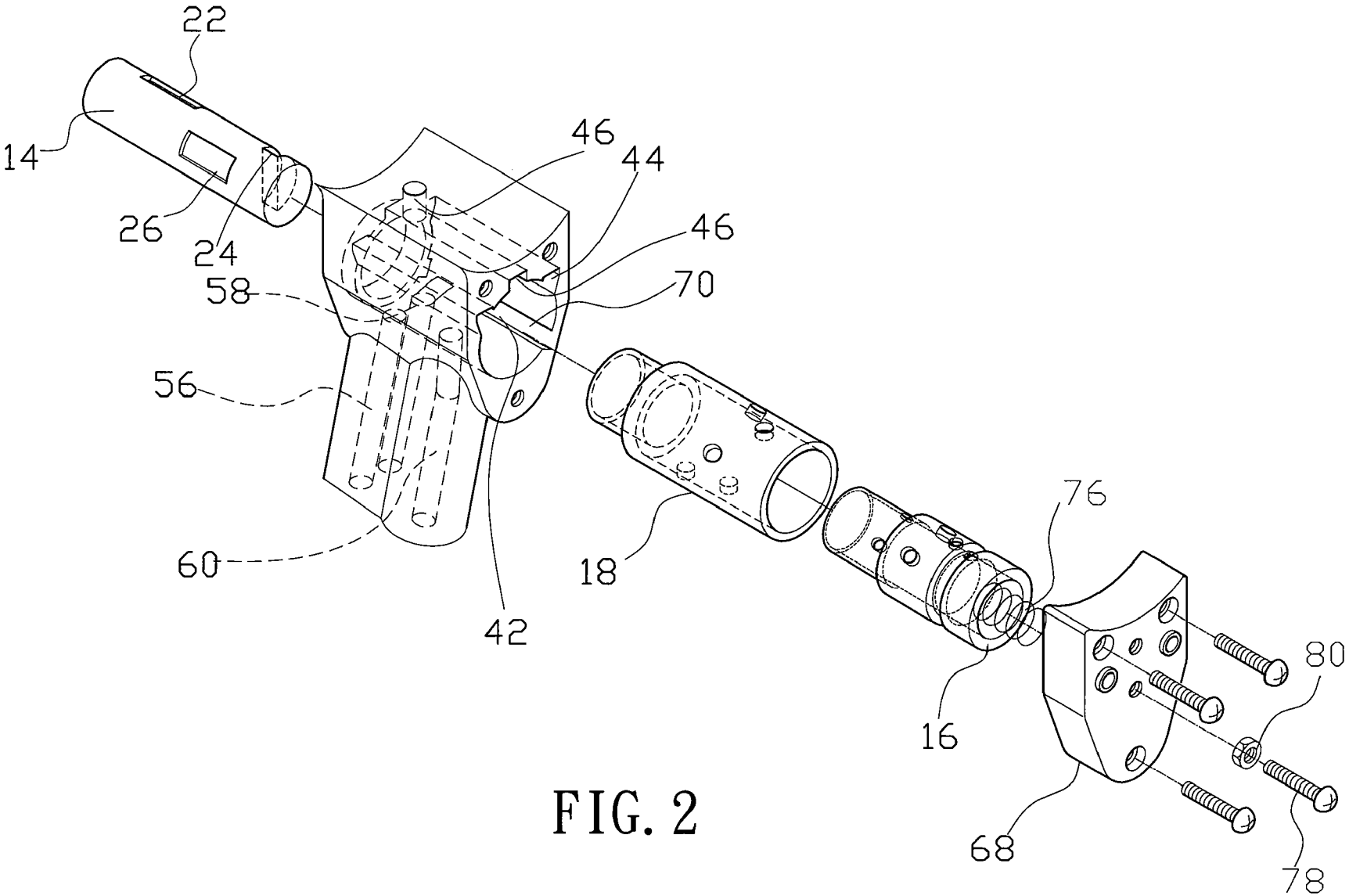
FIG. 2 is an enlarged exploded view of a part of the present invention, showing the structure of the valve unit and the body.
Figure 3A:
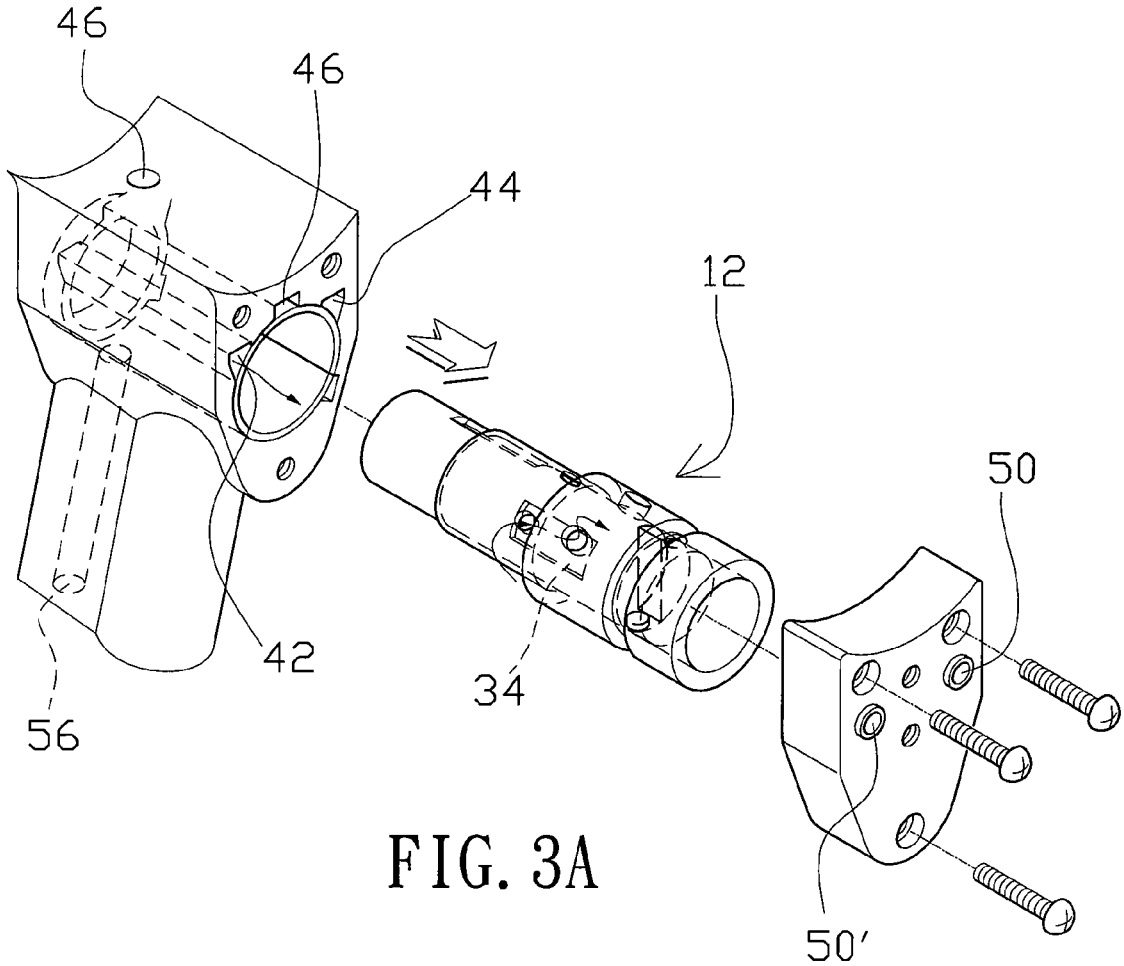
FIG. 3A is an enlarged exploded view of a part of the present invention, showing the structure of the forward rotation control air loop.
Figure 3B:
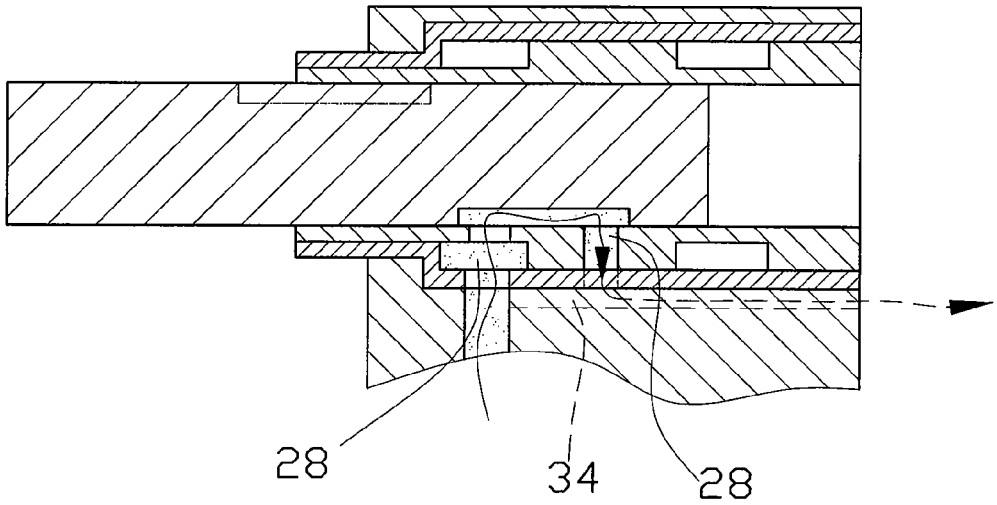
FIG. 3B is a schematic sectional view of the forward rotation control air loop according to the present invention.
Figure 4A:
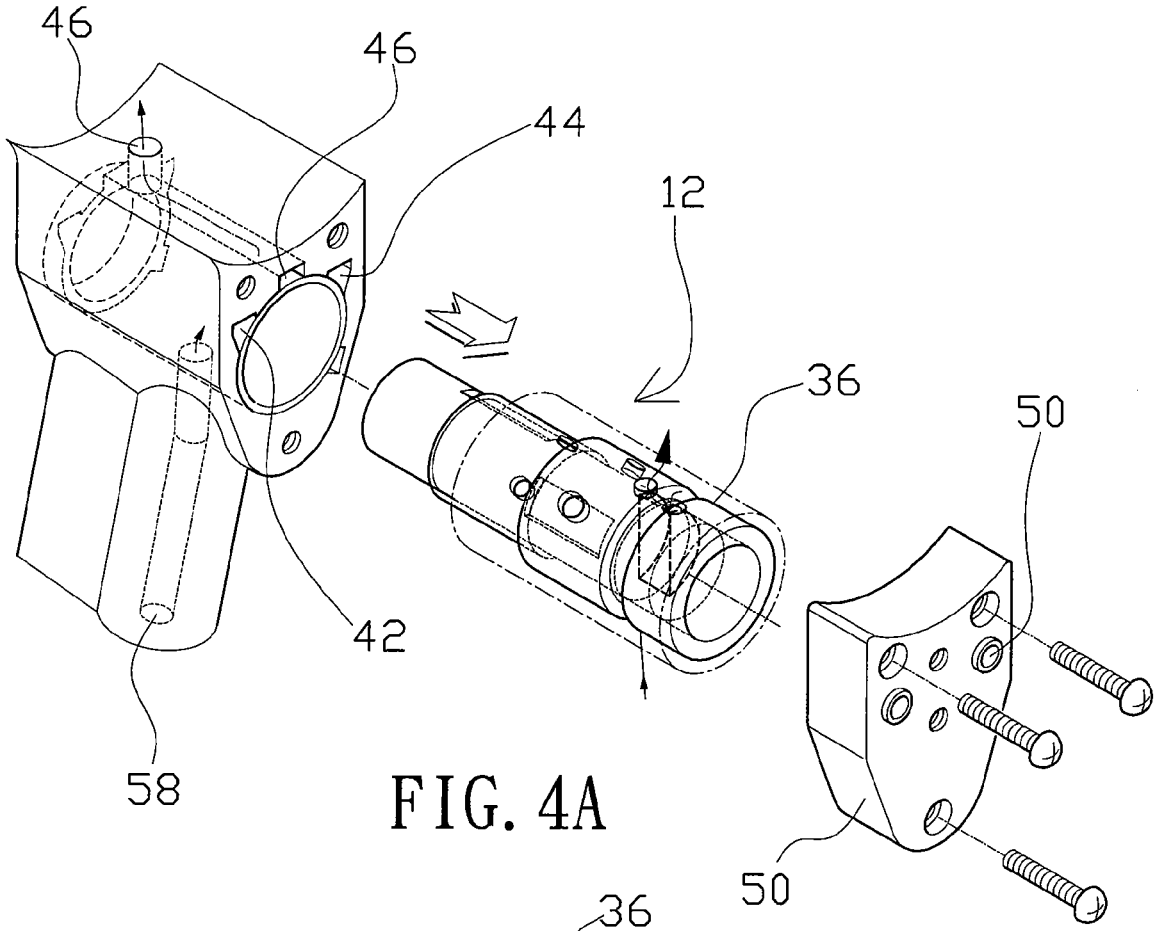
FIG. 4A is an enlarged exploded view of a part of the present invention, showing the structure of the pulling control fluid loop.
Figure 4B:
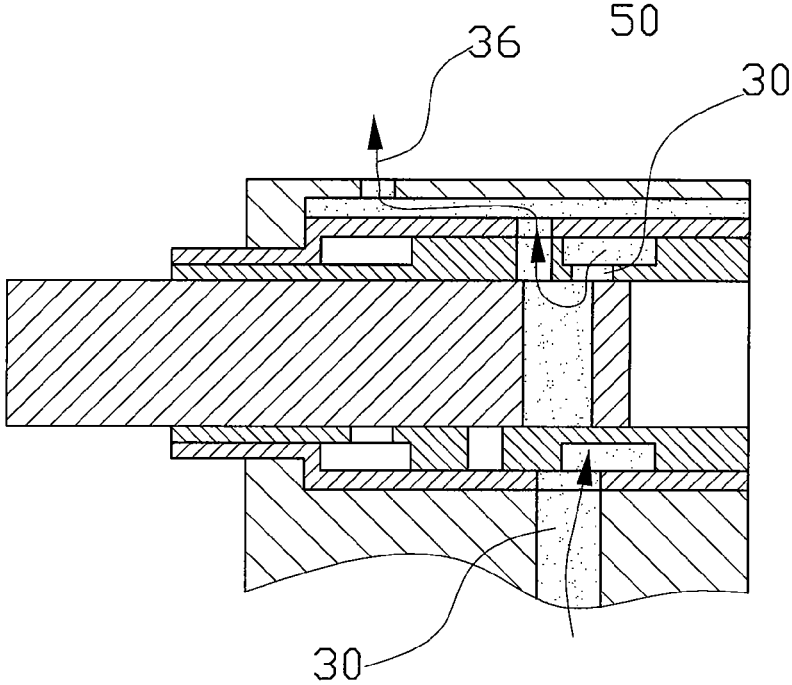
FIG. 4B is a schematic sectional view of the pulling control fluid loop according to the present invention.
Figure 5A:
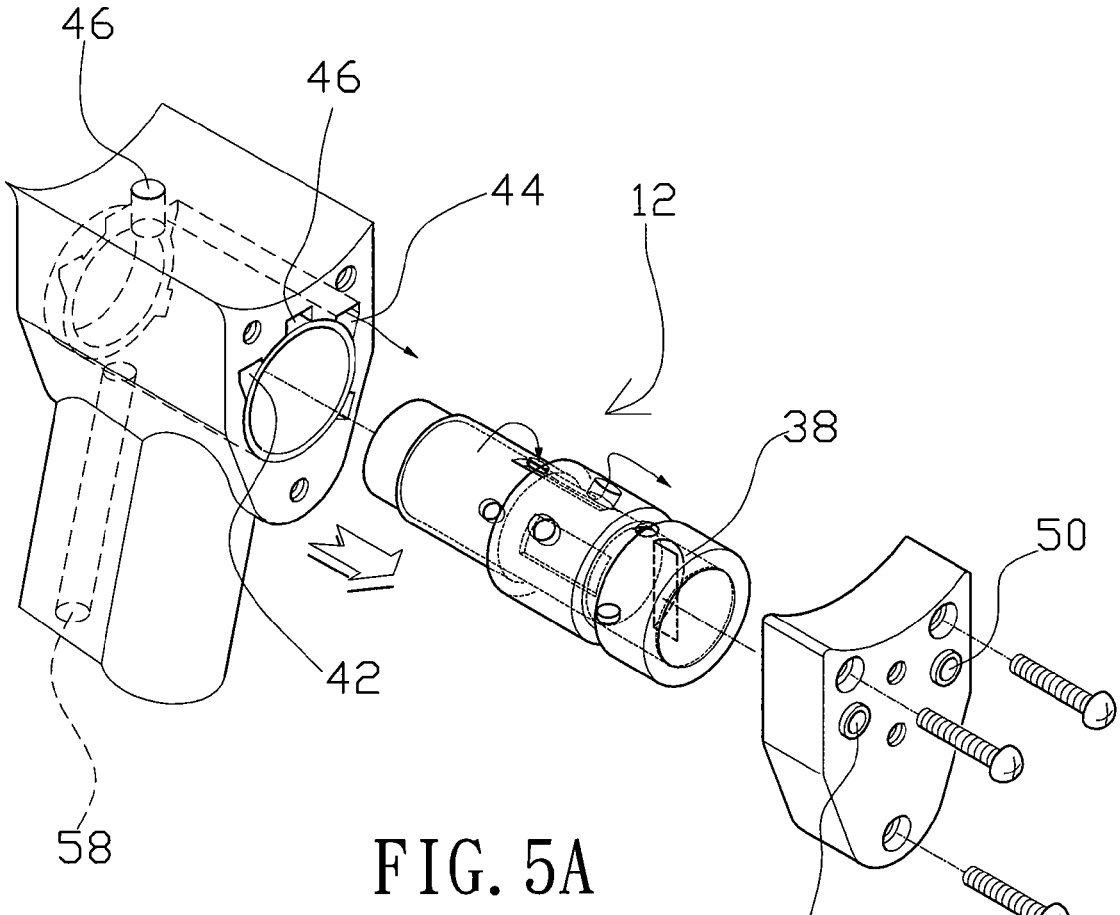
FIG. 5A is an enlarged exploded view of a part of the present invention, showing the structure of the reverse rotation control air loop.
Figure 5B:
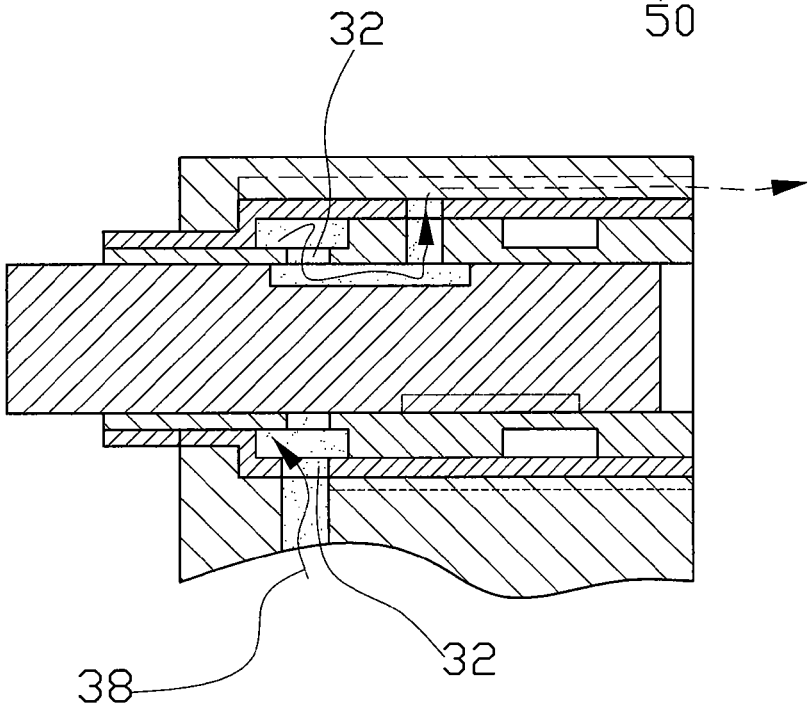
FIG. 5B is a schematic sectional view of the reverse rotation control air loop according to the present invention.
Figure 6:
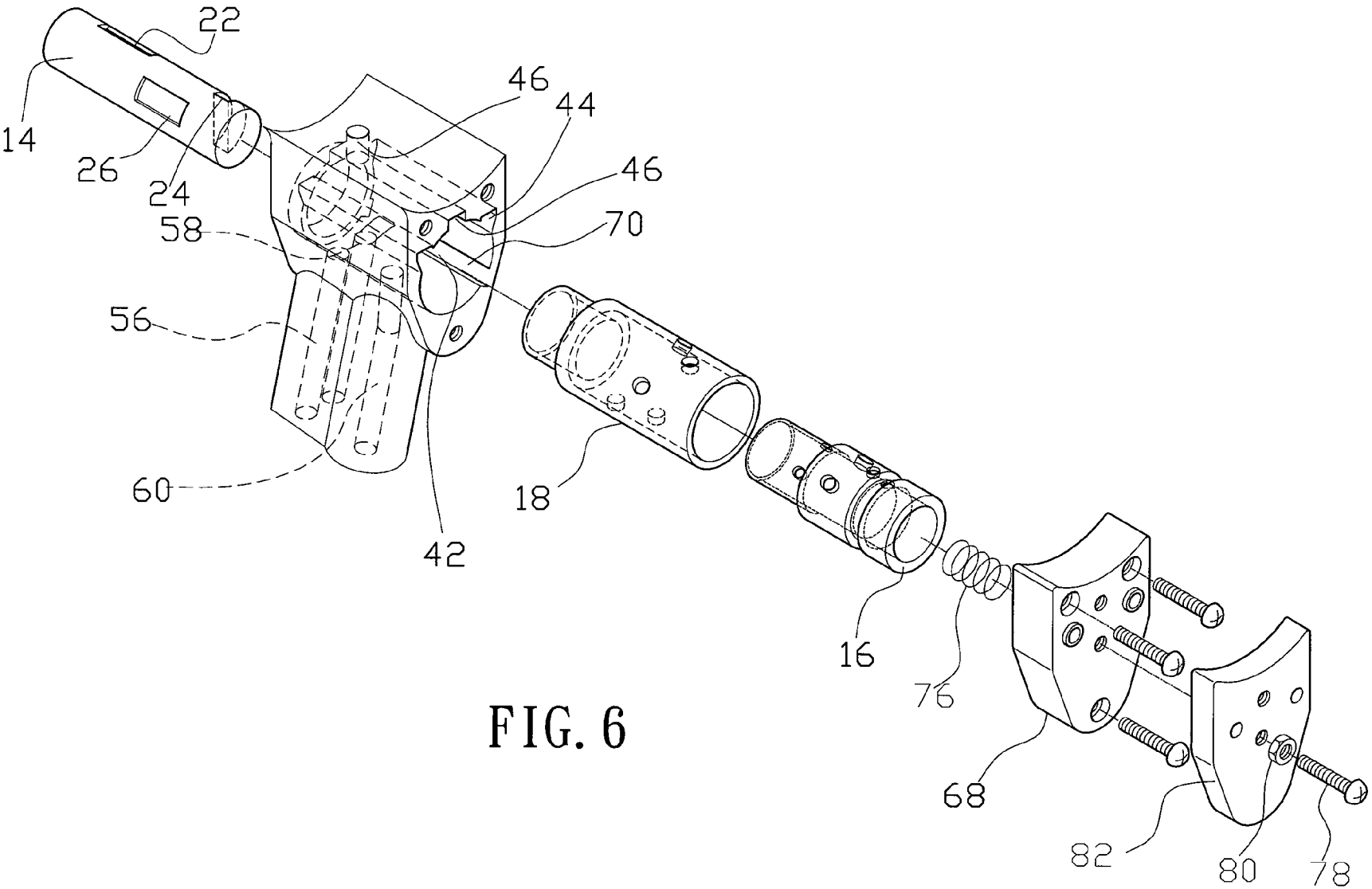
FIG. 6 is an exploded view of an alternate form of the present invention.

By means of using the slidable design of the control valve 14 in the inner barrel 16 to adjust the relative position between the control valve 14 and the socket set 26, the forward rotation control section 20 can be connected to the forward rotation control passage 28 to form a forward rotation control air loop 34 as shown in FIGS. 2A and 2B, the pulling control section 22 can be connected to the pulling control passage 30 to form a pulling control fluid loop 36 as shown in FIGS. 3A and 3B, and the reverse rotation control section 24 can be connected to the reverse rotation control passage 32 to form a reverse rotation control air loop 38 as shown in FIGS. 4A and 4B. When the operator released the hand, the control valve 14 is returned to its former initial position, and the exhaust section is connected to the reverse rotation control air loop 38 for exhaust of air from the air cylinder. The forward rotation control air loop 34, the pulling control fluid loop 36 and the reverse rotation control air loop 38 do not exist at a time, i.e., when the forward rotation control air loop 34 exists, the pulling control fluid loop 36 and the reverse rotation control air loop 38 disappear, and vice versa.

Referring to FIGS. 1 and 2 again, a forward air passage 42, a fluid passage 44 and a reverse air passage 46 are respectively defined in the left upper, upper and right upper sides in the junction between the valve unit 12 and the body 40. The forward air passage 42, the fluid passage 44 and the reverse air passage 46 do not interfere with one another. The forward air passage 42 and the reverse air passage 46 are connected to a compressor motor 48. The fluid passage 44 is connected to a hydraulic unit. Further, a locating device 68 is used to affix the valve unit 12 to the inside of the body 40. According to this embodiment, the locating device 68 is affixed to the body 40 with screws. Further, the locating device 68 has two through holes 50 for guiding air from the forward air passage 42 and the reverse air passage 46 to the compressor motor 48 respectively. Further, a mount 72 is set between the locating device 68 and the compressor motor 48, having through holes 74 corresponding to the through holes 50 of the locating device 68.

The locating device 68 has a center recess (not shown) holding a linear spring 76, which is stopped against the control valve 14, and an adjustment screw 78 and a nut 80 provided at the locating device 68 at one side opposite to the center recess for adjusting the moving distance of the control valve 14.

The compressor motor 48 is abutted at one side of the hydraulic unit (not shown). A leakage-protective partition board 52 is set in between the compressor motor 48 and the hydraulic unit. According to this embodiment, the leakage-protective partition board 52 is fastened to the body 40 with screws, having two through holes 54 respectively connected to the forward air passage 42 and the reverse air passage 46 for guiding air from the forward air passage 42 and the reverse air passage 46 to the compressor motor 48. Further, the leakage-protective partition board 52 has a center axle hole 66 for the passing of a link that is inserted through the hydraulic unit.

The hydraulic unit has a linear spring (not shown) on the inside. During the operation of the hydraulic unit, a hydraulic fluid pressure is produced to move the link backwards. When released the hydraulic fluid pressure, the link is returned to its former initial position.

The aforesaid link has one end suspending inside the compressor motor 48 and the other end terminating in a screw rod 62. The screw rod 62 is mounted with a connector, which has a first coupling portion and a second coupling portion. A nut-riveting riveting unit formed of a pull rod and a nut-riveting bit is fastened to the connector at the screw rod 62. Alternatively, a rivet riveting unit formed of a rivet clamp and a rivet riveting bit can be fastened to the connector at the screw rod 62 to substitute for the aforesaid nut-riveting unit. The nut riveting unit and the rivet riveting unit are hereinafter called the riveting unit. Either the hydraulic unit or the compressor motor 48 can be operated to move the link. Therefore, the riveter of the present invention can be used to rivet a rivet as well as a nut.

The body 40 has an air pump (not shown) on the inside adapted to pump air into a forward rotation air intake hole 56, a fluid trough (not shown), or a reverse rotation air intake hole 58. When air is pumped into the fluid trough, hydraulic fluid is forced out of the fluid trough into a fluid intake hole 60. The forward rotation air intake hole 56, the fluid intake hole 60 and the reverse rotation air intake hole 58 are in communication with the valve unit 12. The forward rotation air intake hole 56 is in communication with the forward rotation control air loop 34 of the valve unit 12. The reverse rotation air intake hole 58 is in communication with the reverse rotation control air loop 38 of the valve unit 12. Therefore, air is allowed to pass through the forward rotation control air loop 34 or the reverse rotation control air loop 38 of the valve unit 12. Further, the fluid intake hole 60 is allowed to communicate with the pulling control fluid loop 36 only.

The operation of the pneumatic/hydraulic riveter is described hereinafter. The pneumatic/hydraulic riveter performs in proper order the forward rotation action, the pulling action, and then the reverse rotation action.

The forward rotation action is outlined hereinafter. When the operator pulled the lever 64 that is pivoted to the body 40, outside air is allowed to pass to the inside of the air pump. When started the air pump, the air pump pumps air into the forward rotation air intake hole 56, the forward rotation control air loop 34, the forward air passage 42 into the compressor motor 48. At this time, the compressor motor 48 rotates the link clockwise, causing clockwise rotation of the screw rod 62, and therefore the nut-riveting unit at the screw rod 62 is rotated clockwise.

When the forward rotation control air loop 34 is closed, the forward rotation action is ended. Because the air pump pumps air into the fluid trough to force hydraulic fluid out of the fluid trough into the fluid intake hole 60, the pulling control fluid loop 36 of the valve unit 12 is opened at this time, allowing hydraulic fluid to pass through the pulling control fluid loop 36 to the hydraulic unit via the fluid passage 44 and to further move the link, and therefore the nut riveting unit or rivet riveting unit is moved with the screw rod 62.

After the pulling action, the air pump is stopped to cut off the pressure from hydraulic fluid, for allowing return of hydraulic fluid to the fluid trough, and the linear spring in the hydraulic unit immediately returns the link, therefore the screw rod 62 is turned to its former initial position.

After the end of the pulling action, the reverse rotation action is followed When closed the pulling control fluid loop 36 is closed, the pulling action is stopped. Because the air pump pumps air into the reverse rotation air intake hole 58, the reverse rotation control air loop 38 is opened, and air is allowed to pass into the reverse rotation control air loop 38 and the reverse air passage 46 and then the compressor motor 48, causing the compressor motor 48 to rotate the link in the reversed direction (counter-clockwise direction), and therefore the nut riveting unit is rotated with the screw rod 62.

As stated above, when pulled the lever 64, the riveting unit runs the forward rotation action, pulling action, and the reverse rotation action in proper order. When released the pressure from the lever 64, air passes out of the compressor motor 48 to the outside via the exhaust hole 70, and therefore the reverse (counter-clockwise) rotation of the riveting unit is stopped.

As stated above, the invention uses one single control valve unit 12 to control forward rotation and reverse rotation, eliminating the drawback of the prior art design that uses two valves to control forward rotation and reverse rotation respectively, and saving much the cost. Further, the invention uses the forward rotation air intake hole 56 and the reverse rotation air intake hole 58 to provided air necessary for forward rotation and reverse rotation respectively, so that the riveted nut can be removed from the riveter safely after the reverse rotation action.

When a rivet riveting unit is used with the pneumatic/hydraulic riveter of the present invention, the compressor motor is removed from the body of the riveter, and a back cover 82 is closed on the back side of the body of the riveter. The back cover 82 has a plug that blocks the forward air passage 42. Thereafter, the adjustment screw 78 is rotated inwards to limit the moving distance of the control valve 14 to the pulling control section 22, and therefore the riveter can only perform the pulling action.

A prototype of pneumatic/hydraulic riveter has been constructed with the features of FIGS. 1~6. The pneumatic/hydraulic riveter functions smoothly to provide all of the features discussed earlier.

Although particular embodiments of the inventions have been described in detail for purposes of illustration, various modifications and enhancements may be made without departing from the spirit and scope of the invention. Accordingly, the invention is not to be limited except as by the appended claims.

The invention claimed is:

1. A pneumatic/hydraulic riveter comprising:

a body, said body comprising an air pump, a compressor motor, a forward rotation air intake hole in air communication with said compressor pump, a fluid intake hole in communication with said compressor pump, a reverse rotation air intake hole in communication with the compressor pump, a lever adapted to drive said air pump, a hydraulic unit, a riveting unit, and an exhaust hole, said riveting unit being driven to perform in the sequence of a forward rotation action, a pulling action and a reverse rotation action when said lever is biased, said exhaust hole being for exhaust of air from said compressor motor when said lever is released; and a valve unit mounted inside said body, said valve unit comprising a control valve and a socket set, said control valve being movable relative to said socket set to a first position to provide a forward rotation control air loop, a second position to provide a pulling control fluid loop, and a third position to provide a reverse rotation control air loop in such a manner that when one loop is provided the other two loops are closed, said forward rotation control air loop being in air communication between said compressor motor and said forward rotation air intake hole during forward rotation action of said riveting unit, said pulling control fluid loop being in fluid communication between said hydraulic unit and said fluid intake hole during pulling action of said riveting unit, said reverse rotation control air loop being in air communication between said compressor motor and said reverse rotation air intake hole during reverse rotation action of said riveting unit.

2. The pneumatic/hydraulic riveter as claimed in claim 1, wherein said air pump is controllable to pump air from said forward rotation air intake hole into said forward rotation control air loop and then into said compressor motor to further cause said compressor motor to rotate said riveting unit in clockwise direction.

3. The pneumatic/hydraulic riveter as claimed in claim 1, wherein said air pump is controllable to pump air to force a hydraulic fluid into said fluid intake hole and then into said hydraulic unit via said pulling control fluid loop to cause said hydraulic unit to pull said riveting unit.

4. The pneumatic/hydraulic riveter as claimed in claim 1, wherein said air pump is controllable to pump air from said reverse rotation air intake hole into said reverse rotation control air loop and then into said compressor motor to further cause said compressor motor to rotate said riveting unit in counter-clockwise direction.

5. The pneumatic/hydraulic riveter as claimed in claim 1, wherein said control valve has a forward rotation control section, a pulling control section, and a reverse rotation control section; said socket set comprises a forward rotation control passage, which constitutes with said forward rotation control section said forward rotation control air loop, a fluid control passage, which constitutes with said pulling control section said pulling control fluid loop, and a reverse rotation control passage, which constitutes with said reverse rotation control section said reverse rotation control air loop.

6. The pneumatic/hydraulic riveter as claimed in claim 1, wherein said body has a forward air passage in communication between said forward rotation control air loop and said compressor motor, a fluid passage in communication between said pulling control fluid loop and said hydraulic unit, and a reverse air passage in communication between said reverse rotation control air loop and said compressor motor.

7. The pneumatic/hydraulic riveter as claimed in claim 6, wherein said socket unit comprises an outer barrel, an inner barrel mounted in said outer barrel; said forward rotation control passage, said pulling control passage and said reverse rotation control passage are respectively provided between said inner barrel and said outer barrel.

8. The pneumatic/hydraulic riveter as claimed in claim 6, further comprising a locating device set between said compressor motor and said valve unit to affix said valve unit to said body, said locating device having a first through hole in communication with said compressor motor through said forward air passage, and a second through hole in communication with said compressor motor through reverse air passage.

9. The pneumatic/hydraulic riveter as claimed in claim 8, wherein said riveting unit is a nut-riveting riveting unit or rivet-riveting riveting unit.

10. The pneumatic/hydraulic riveter as claimed in claim 9, wherein said riveting unit is adapted to rivet blind nuts, and comprised of a connector mounted on a screw rod of a link being rotatably and axially slidably mounted in said body, a pulling rod connected to said connector, and a nut-riveting bit mounted on said connector.

11. The pneumatic/hydraulic riveter as claimed in claim 9, wherein said riveting unit is adapted to rivet blind rivets, and comprised of a connector mounted on a screw rod inside said body, a rivet clamp mounted on said connector for clamping a blind rivet, and a riveting tip for riveting the blind rivet clamped by said rivet clamp.

* * * * *